US006594849B1

(12) United States Patent
Nimens

(10) Patent No.: US 6,594,849 B1
(45) Date of Patent: Jul. 22, 2003

(54) PLUMBING DEVICE

(76) Inventor: Jon Nimens, 1400 Woodman La., Crookston, MN (US) 56716

( * ) Notice: Subject to any disclaimer, the term of this patent is extended or adjusted under 35 U.S.C. 154(b) by 372 days.

(21) Appl. No.: 09/609,273

(22) Filed: Jun. 30, 2000

(51) Int. Cl.[7] ..... B08B 9/02; B08B 1/00; B08B 7/00; E03D 9/00

(52) U.S. Cl. ..... 15/104.33; 4/255.04; 4/255.06; 134/169 C; 15/104.31; 15/104.09

(58) Field of Search ..... 15/104.31, 104.09, 15/104.095, 104.16, 104.2, 104.33; 4/255.01, 255.04, 255.06, 255.08; 134/169 C

(56) References Cited

U.S. PATENT DOCUMENTS

| | | | | | |
|---|---|---|---|---|---|
| 831,722 | A | * | 9/1906 | Holmes | 4/255.06 |
| 898,234 | A | * | 9/1908 | Lisenby | 137/216.1 |
| 5,107,550 | A | * | 4/1992 | Hawro | 4/255.08 |
| 5,509,148 | A | * | 4/1996 | Steele et al. | 15/104.05 |

* cited by examiner

*Primary Examiner*—Robert J. Warden, Sr.
*Assistant Examiner*—Laure C Cole
(74) *Attorney, Agent, or Firm*—Robert E. Kleve

(57) ABSTRACT

The invention comprises a drain cleaning apparatus having a flexible forward tubular portion and a rigid real-ward tubular portion. The flexible portion is coupled to a drain pipe of a building connected to the sewer line, after the elbow connection between the drain pipe section and the drain in a sink in the building has been removed. The rearward tubular portion has a bowl with an open top and a spout is mounted over the bowl with a fluid connection connecting the spout to a spout of the faucet to fill the bowl and apparatus and drain pipe up to any blockage in the drain pipe. The rearward tubular portion having a bypass pipe opening for receiving a rotary drain cleaning cable it its augering end so it may be slid along the apparatus and drain pipe to any blockage in the drain pipe, whereupon the cable may be rotated in the apparatus and drain pipe to auger through any blockage in the drain pipe and water in the drain pipe and apparatus ma) run down the drain pipe emptying the bowl to indicate the drain pipe has been unclogged. The apparatus has a water bypass which can in turn be connected to a source of water so that a continous flow of water can be introduced into the apparatus and drain pipe through the unblocked portion of the drain pipe while the drain cleaning cable continues to be rotated in the drain pipe to further clean the drain pipe and cable.

7 Claims, 3 Drawing Sheets

PLUMBING DEVICE

This invention relates to drain cleaning devices, more particularly the invention relates to drain cleaning for cleaning the drain outlets.

It is an object of the invention to provide a novel drain cleaning apparatus for attachment to the drain outlet of a drain to a building after a elbow connection between the drain outlet and a drain of a sink has been removed for cleaning out an obstruction in the drain outlet having a tubular member for receive a rotary drain cleaning cable with a water outlet to the apparatus for providing water to the cleaning cable while in the apparatus and drain outlet to further clean the drain outlet as well as clean the drain cleaning cable while in the drain outlet and in the apparatus.

It is a further object of the invention to provide a drain cleaning apparatus with fluid connection to a source of fluid to provide a fluid to a rotary drain cleaning cable while rotating in a drain outlet to open a blockage in the drain outlet.

Further objects and advantages of the invention will become apparent as the description proceeds and when taken in conjunction with the accompanying drawings wherein:

BRIEF DESCRIPTION OF PREFERRED EMBODIMENT

Briefly stated, the invention comprises a drain cleaning apparatus having a tubular frame, coupling means at the forward end of the end of the tubular frame for attachment to the drain outlet of a drain after an elbow connection between the drain outlet and a drain of a sink, has been removed, means on the tubular frame for receiving tile auger end of a rotary drain cable for sliding the cable through the tubular frame and into the drain outlet to rotate the auger to auger through any obstruction in the drain outlet, means to introduce water into the drain outlet and along the cable while in the drain outlet to flush and clean the cable and drain Outlet while rotating the drain cleaning cable.

Figure 1:
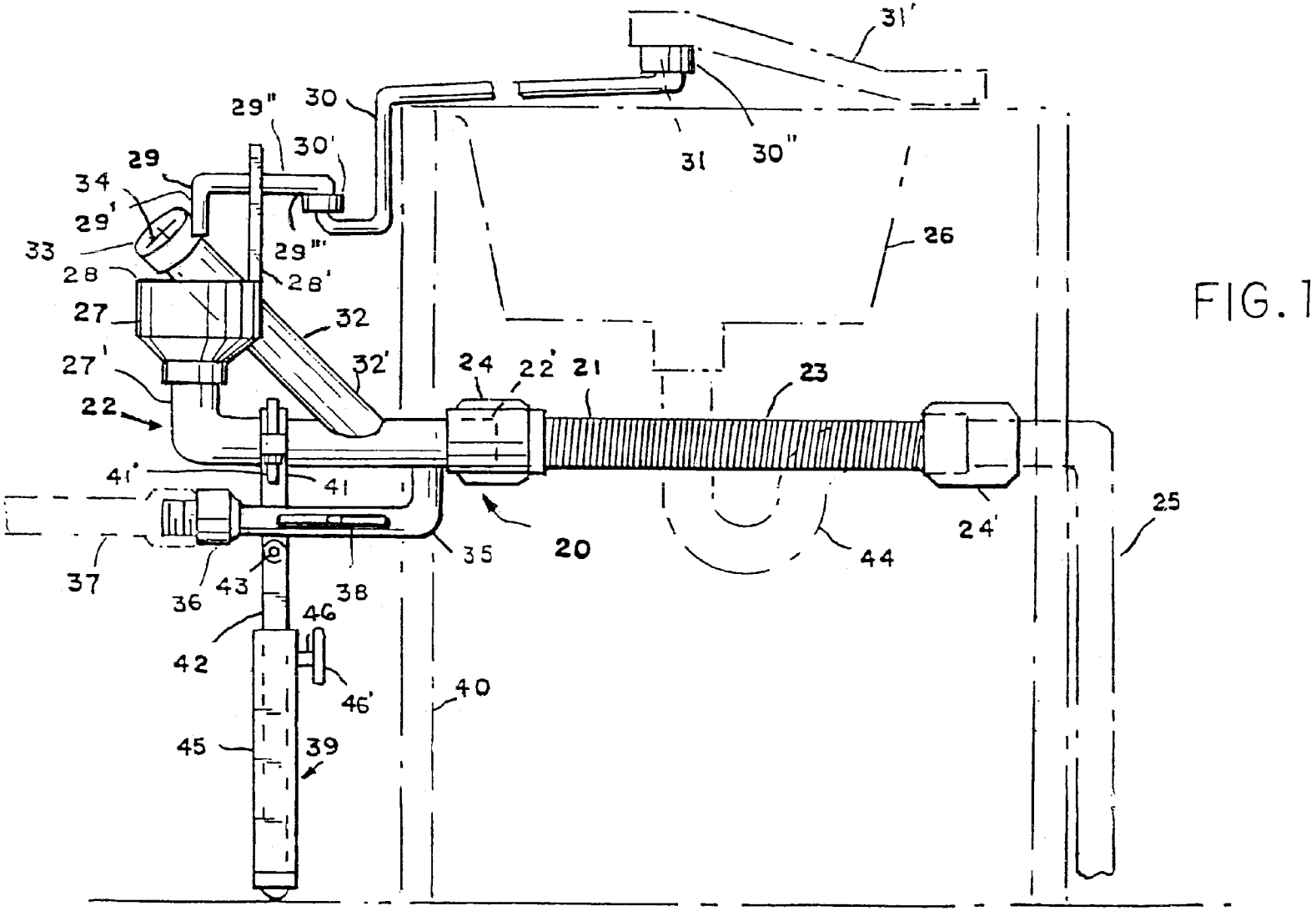
FIG. 1 is a side elevational view of the drain cleaning apparatus shown attache to the drain outlet of a drain after the elbow connection between the drain outlet and a drain of a sink was removed.
Figure 2:
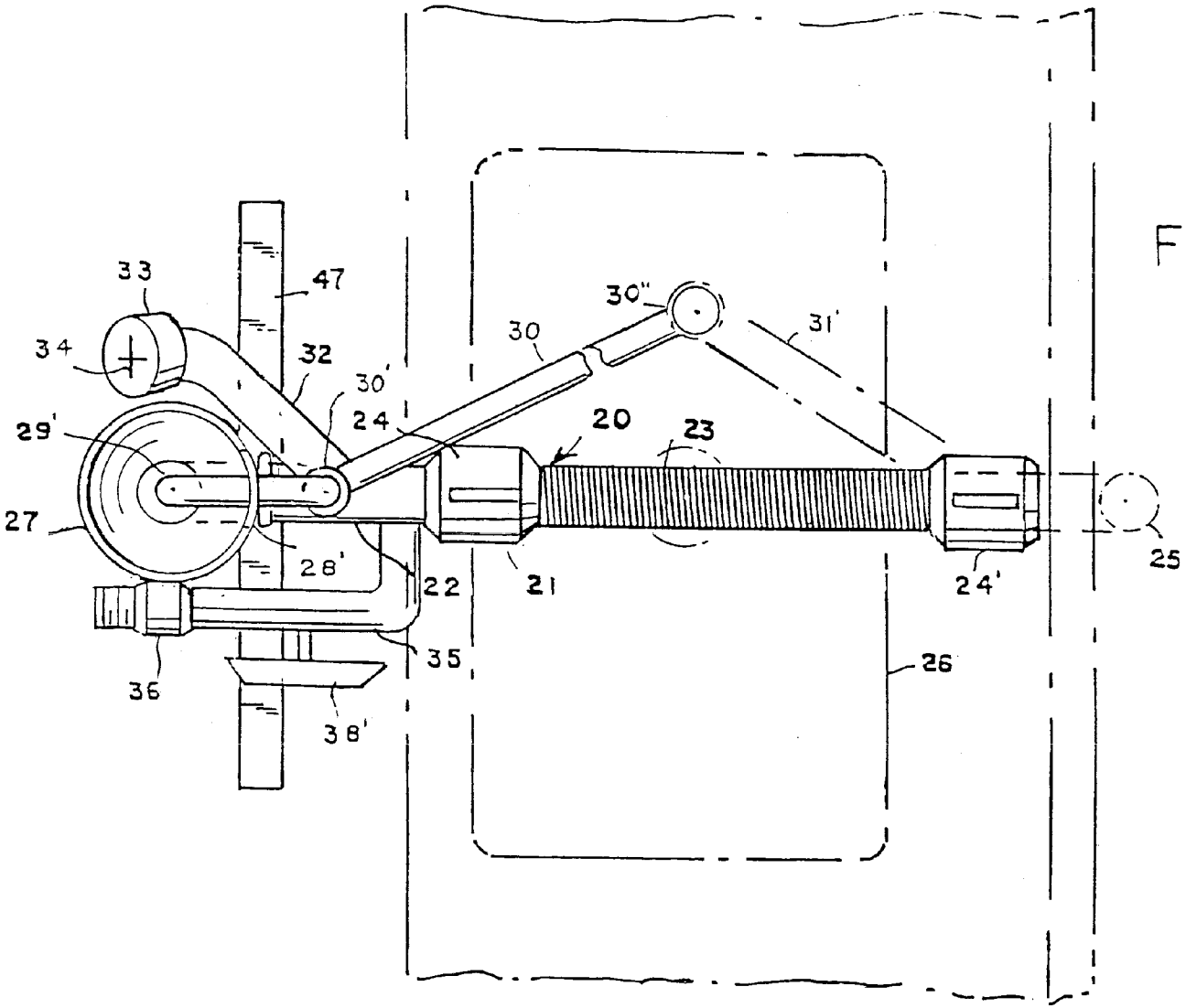
FIG. 2 is a top plan view of the drain cleaning apparatus.
Figure 3:
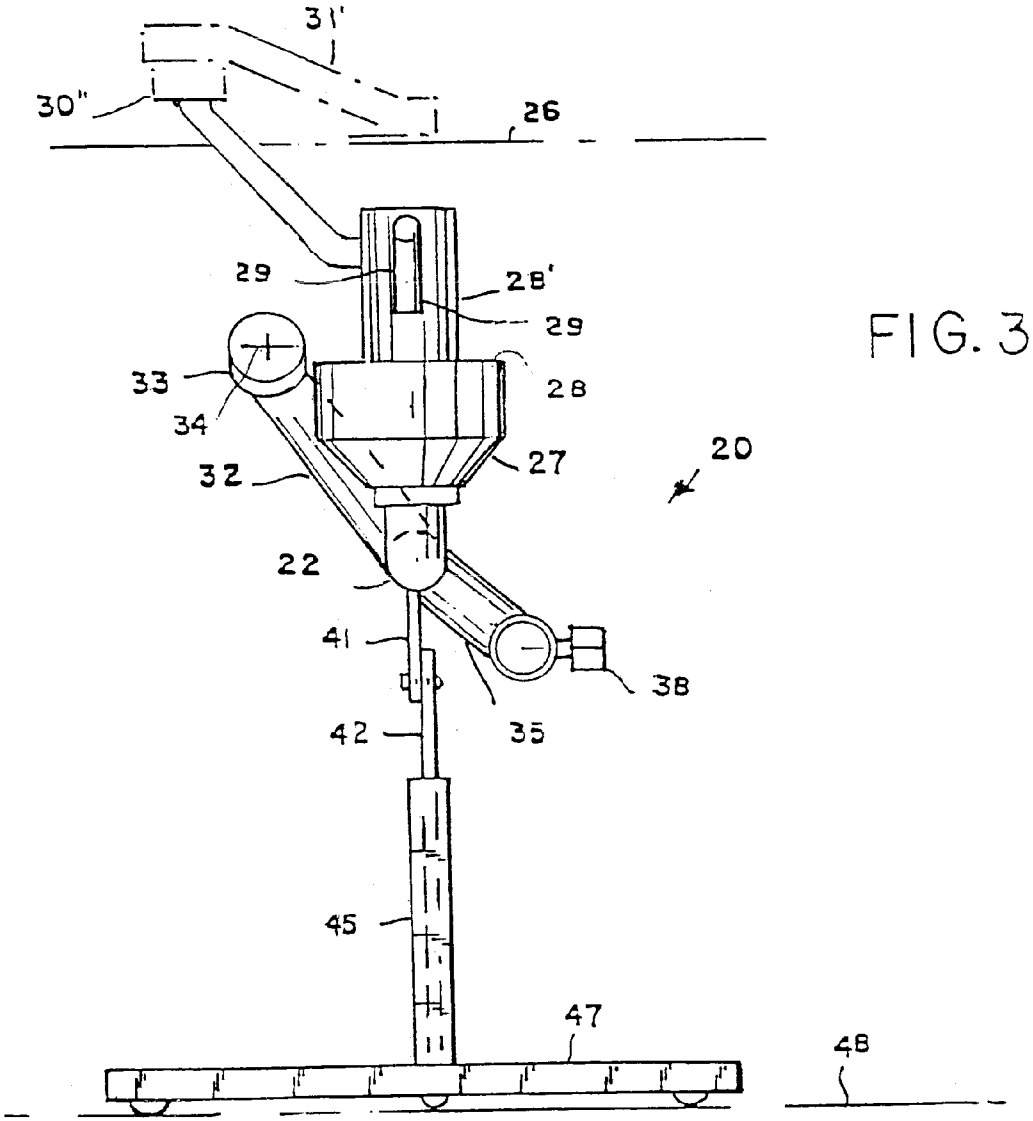
FIG. 3 is a rear elevational view of the drain cleaning apparatus.

Referring more particularly to the drawings, the cleaning invention is shown in FIGS. 1–3, inclusive.

In FIGS. 1–3, inclusive, the drain cleaning apparatus or device 20 is illustrated. The apparatus 20 has a horizontal main pipe section 21 with a rigid rear section 22 and a detachable flexible pipe section at its forward end. The flexible pipe section 23 has a front and rear coupling 24 and 24', respectively. The front detachable coupling 24' is for attachment coaxially about the outlet pipe 25 of the sink to be cleaned by the apparatus in the house (not shown ). The rear coupling 24 is for attachment to the forward end 22' of the rigid rear pipe section 22. The rigid pipe section 22 of the invention has a bowl 27 mounted at the elbow portion 27' of the rigid rear end of the pipe section 22. The bowl has an open top 28 and a upright flange 28' fixed to the upper forward end of the bowl. The upright flange has a spout 29 with a open rear bottom 29' centered over the center of the open top of the bowl 27. The spout has an intermediate pipe section 29" fixed to the upright flange and it extends forward through tile upright flange. A flexible pipe section 30 is coupled to the forward end 29"' of the spout by a coupling 30'. The flexible pipe section 30 has a coupling 30" at its forward end which is coupled to the spout 31 of faucet 31' mounted to the top of the sink 26, so that water released from the faucet may travel from the spout of the faucet through the flexible pipe section 30 to the spout 29 where the water may flow out the open end of the spout into the bowl 27 of the apparatus.

A bypass pipe section 32 has its forward end 32' moulded with and in fluid communication with the rigid rear pipe section 22. The bypass section 32 extends diagonally rearward and upward with a rubber cap 33 attached over the rear open end of the bypass pipe 32. The rubber cap has a vertical and horizontal slit 34 through the rubber cap, so that a augering end of a rotatable drain cleaning cable of a conventional ROTOROOTER (trademark) type drain cleaner may be inserted into the bypass pipe section through the slits in the rubber cap and then slid forward along the bypass section 32 and forward along the rigid and then flexible pipe sections 22 and 23 into the drain pipe 25 in tile house, and then forward and downward in the drain pipe 25 of the house.

A second by pass pipe section 35 is molded with and in fluid communication with the rigid pipe section 22 and extends downward and rearward with a coupling 36 at its rearward end for attachment to a conventional water or garden hose 37. The section 35 has a valve 38 for opening and closing the pipe section 35. The pipe section 35 will be opened by the valve 38 for draining the rigid and flexible pipe sections of the apparatus after the use of the water in the apparatus from the faucet has been completed.

A stand 39 for the apparatus is pivotally mounted to the bottom of the rigid pipe section 22 of the device 20 for supporting the rear of the device or apparatus outside the cabinet 40 of the house supporting the sink, whose outlet pipe 25 is being cleaned. The stand 39 supports the rear of the device 20, while the forward end of the device 20 is being supported by its flexible pipe section 23 being coupled to the outlet pipe 25 being cleaned. The stand has an upper frame member 41 fixed to the bottom of pipe section 22 by a U clamp 41'. A bottom frame member 42 is pivotally mounted to the upper pipe section 41 at pivot point 43. The lower portion of frame member 42 is slidably mounted in a pipe 45 and a threaded rod 46, with a handle 46', is threaded into the side of pipe 45 against rod or frame member 42 to lock the frame member 42 at a selected height. The lower end of pipe 45 has a horizontal plate 47 fixed thereto which engages the floor 48 of the house adjacent the cabinet, for supporting the rear of the device outside the cabinet. The rear pipe section 23 may be raised or lowered relative to the floor, by the sliding adjustment of member 42 relative to the pipe 42 up or down to lock the rear end of the apparatus at a selected height relative to the floor and cabinet.

In its operation, the drain cleaning apparatus 20 will operate as follows:

Assuming the drain to be cleaned is conventional sink outlet drain pipe 25 in kitchen, the operator will remove the conventional elbow joint connection 44, which was connected between the sink outlet drain 45 of the sink 26 and the outlet drain 25 shown in phantom lines in FIG. 1. The drain outlet 25 connects in turn with the street drain. The operator will then couple the front coupling 24' of the flexible pipe section 23 of the drain cleaning apparatus 20 to the outlet pipe 25, to which the elbow connection 44 had previously been connected to. The stand 39 will be placed on the floor 48 outside the cabinet 40 of the sink, and the handle 46' will be rotated to loosen the sliding connection of member 42 and 45, so that the member 42 may be slid to a selected height, so that the rigid and flexible pipe sections of the apparatus 20 will be aligned generally horizontal with the top of the outlet pipe 25, as shown in FIG. 1.

The flexible pipe section 30 will then be coupled at its forward end to the spout 31 of the faucet and then the handle of the faucet will be turned on to allow water to flow from the faucet through the pipe section 30 out the spout 29 into the bowl 27, where the water will then flow down the bowl 27 along the rigid and flexible pipe sections 22 and 23, respectively, and along the drain outlet pipe 25 to the clogged point in the outlet pipe 25, assuming the outlet pipe 25 is clogged or blocked and no water can flow through the pipe 25. The water will start filling up the outlet pipe 25 and the pipe sections 22 and 23 of the apparatus until the water backs up along the connections and begins filling up the bowl 27. When the water backs up enough to fill the bowl 27 to near its top, the operator will turn off the water from the faucet.

The operator will then insert the augering end of a conventional rotary drain cleaning cable, not shown, into and through the slits in the resilient flexible rubber cap 33 and force the cable clown along the bypass pipe section 32, then along the rigid pipe section 22 and flexible pipe section 23 and then down along the outlet drain pipe 25 until the augering end of the rotary drain cleaning cable reaches the clogged portion of the drain outlet pipe 25.

The operator will then rotate the drain cleaning cable in the apparatus 20 and outlet pipe 25 until the augering end augers through the material clogging the outlet pipe 25. Once the augering end of the drain cleaning cable has augered through the material clogging the drain; the water in the bowl 27, in the rigid and flexible pipe sections 22 and 23 of the apparatus and along the outlet pipe 25, in behind the clogged portion of the outlet pipe will rush forward through the now unclogged portion of the pipe and the water in the bowl 27 will suddenly drop down. The operator will monitor the water level in the bowl 27, and when the water level suddenly drops down, he will know that the drain outlet pipe 25 has become unclogged. He will then turn the water back on from the water faucet 32, so as to provide a continous flow of water into the bowl and through the apparatus pipe sections 22 and 23 and along the outlet pipe 25, beside the drain cleaning cable, while the operator continues to rotate the drain cleaning cable in the pipe sections 22 and 23 and the outlet pipe 25 to flush the cable and pipes. The water from the faucet will be allowed to continue to flow to flush all the material clogging the drain down along the drain; and it will also act to clean the drain cleaning cable while it is in the apparatus and outlet pipe, as well as clean the pipes. The operator will continue to run water down through the apparatus and along the outlet pipe and down along the drain cleaning cable until he feels the apparatus, outlet pipe, and cable have been adequately cleaned.

The second bypass connector 35 of the apparatus has been closed throughout the foregoing operation. The operator will turn the handle 38' to open the bypass to allow water in the apparatus to drain out through the garden hose attached to the bypass pipe 35. At this time, the operator will rewind the drain cleaning cable to remove the drain cable from the entire apparatus and the outlet pipe 25, by taking out the first bypass pipe 32 through the rubber cap 33.

The invention 20 enables the outlet pipe 25 of the house to be more thoroughly cleaned by the flushing of the outlet pipe with faucet water through the apparatus and out the outlet pipe 25, and it also enables the drain cleaning cable to be thoroughly cleaned while still in the apparatus pipe sections 22 and 23 and while still in the outlet pipe 25, before removal from them. This enables the operator not to have to handle a dirty drain cleaning cable when removing it from the drain outlet pipe after use in unclogging the outlet pipe and after he is done unclogging the drain outlet pipe. The flushing of the water also enables a more thorough cleaning of the outlet pipe to be accomplished, once the area has become unclogged by the rotation of the drain cleaning cable.

Thus, it will be seen that a novel drain cleaning pipe apparatus has been provides which can be attached to the outlet pipe of a house beneath the sink and which can receive the augering end of a conventional rotary drain cleaning cable and which cable can be extended through the apparatus into the outlet pipe to the clogged area and rotated to auger through the clogged area, and wherein the pipe apparatus may receive water while the cable remains in the apparatus and outlet pipe to clean the outlet pipe and the cable before it is removed.

The coupling members 24 and 24' at each end of the flexible hose 23 are of a conventional type having levers 24"' which are pivotally mounted to the coupling to lever the rigid pipe 22 tight against an ring seal in the coupling 24 and lever the coupling seal tight against the outlet pipe 25 to seal them together in fluid communication, and enable them to be easily and quickly attache(d and detached.

The apparatus may also be used to clean urinal drain, outlet pipes by removing the urinal from the wall and then attaching the coupling 24' to the drain outlet pipe behind the urinal.

The apparatus may also be used to clean other drain outlet pipes.

It will be obvious that various changes and departures may be made to the invention without departing from the spirit and scope thereof; and accordingly it is not intended that the invention be limited to that specifically described in the specification, or as illustrated in the drawing, but only as set forth in the appended claims wherein;

What is claimed is:

1. A drain cleaning apparatus for cleaning a drain outlet pipe comprising a rigid pipe section, a flexible pipe section, a vertically extendable stand mounted to the rigid pipe section, said flexible pipe section having a rear end detachably coupled to the forward end of the rigid pipe section, said flexible pipe section having a forward end adapted to be detachably coupled to the drain outlet pipe, said rigid pipe section having a bowl at its rear end, said rigid pipe connection having first bypass pipe connection bypassing the bowl for receiving a rotary drain cleaning cable at its augering end said rigid pipe connection having a second by pass pipe connection for receiving water from a water hose, a third pipe connection for connecting to a water faucet spout at its one end and having its other end directed down into the bowl of the drain cleaning apparatus, whereby water may be run from the faucet into the bowl to enable water to run along the rigid pipe, flexible pipe and outlet pipe connection to a clogged portion of the outlet pipe, until the water has nearly filled back up to the top of the bowl and then turned off, and a rotary drain cleaning cable at its auger end may be introduced into the apparatus through the first bypass pipe connections and slid forward along the rigid and flexible pipe connections and along the outlet pipe to the clogged portion of the pipe and then the cable may be augered to rotate the augering end of tie cable to auger through the clogged portion of the cable to cause the water from the faucet in the apparatus and outlet pipe to drain suddenly causing the water to drop in the bowl to signal the clogged portion of the pipe has become unclogged, whereupon, water from a water hose may be introduced from the second bypass pipe connection into the apparatus and along the rigid and flexible pipe sections and along the outlet pipe through the unclogged portion while the cable is in the apparatus and outlet pipe to clean the outlet pipe and to clean the cable while the cable remains in the outlet pipe and apparatus before removing the cable.

2. A drain cleaning apparatus for cleaning a drain comprising a detachable elongated main tubular conduit having a forward end and a rearward portion, attachment means at the forward end portion of the main tubular conduit to attach the main conduit to a drain outlet pipe, an opening means adjacent the rearward end portion of the main tubular conduit to receive an auger end of a rotary drain cleaning cable, water introduction means adjacent the rearward portion of the main tubular conduit to introduce water into the main tubular conduit.

3. A drain cleaning apparatus according to claim 2, wherein said opening means for receiving an auger comprises a first bypass conduit portion extending upward from adjacent said rearward portion of said main tubular conduit with an opening above said main tubular conduit, and wherein said water introduction means has a branch conduit portion extending upward from said rearward portion of said main tubular conduit, and has an upper end portion for fluid communication, to receive water into the branch conduit portion and into the main tubular conduit.

4. A drain cleaning apparatus according to claim 3, wherein said branch conduit portion has an enlarged receptacle portion intermediate its upper end portion with an open top for viewing, and a spout portion above the receptacle for feeding water into the receptacle portion, wherein water in the enlarged receptacle portion of the branch conduit portion drains when an obstacle in the drain outlet pipe is removed.

5. A drain cleaning apparatus according to claim 3, wherein a second bypass conduit portion is attached at the rearward end of the main tubular conduit and extends downward for attachment to a water source, wherein the second bypass conduit portion includes a valve for closure of the second bypass conduit portion.

6. A drain cleaning apparatus according to claim 3, wherein the main tubular conduit has a stand mounted on the rearward portion for supporting the drain cleaning apparatus on the floor adjacent the drain outlet pipe when operating the drain cleaning apparatus.

7. A drain cleaning apparatus for cleaning a drain comprising a detachable elongated main tubular conduit having a forward and rearward portion, detachable coupling attachment means at the forward end of the tubular conduit to attach the main tubular conduit to a drain outlet pipe, a stand mounted adjacent to a rearward portion of the main tubular conduit for supporting a rearward portion of the apparatus, an opening means at the rearward end of the main tubular conduit for receiving an auger end of a rotary drain cleaning cable to enable the auger end to be slid into the opening means through the main tubular conduit and into the drain outlet pipe, whereby the auger may be rotated in the main tubular conduit and in the drain outlet pipe to auger through obstruction in the drain outlet pipe, water introduction means adjacent the rearward end of the main tubular conduit to introduce water into the main tubular conduit and along the drain outlet pipe and along the cable, while the cable is in the main tubular conduit and drain outlet pipe to flush and clean the cable and drain outlet pipe while rotating the drain cleaning cable.

* * * * *